United States Patent [19]

Welti

[11] 4,201,963

[45] May 6, 1980

[54] 3-POSITION, 4-PORT WAVEGUIDE SWITCH

[75] Inventor: George R. Welti, Leesburg, Va.

[73] Assignee: Communications Satellite Corporation, Washington, D.C.

[21] Appl. No.: 872,709

[22] Filed: Jan. 26, 1978

[51] Int. Cl.[2] ..... H01P 1/12

[52] U.S. Cl. ..... 333/106; 333/108

[58] Field of Search ..... 333/7 R, 98 S; 200/37 R, 37 A, 153 S

[56] References Cited

U.S. PATENT DOCUMENTS

| | | | |
|---|---|---|---|
| 2,912,694 | 11/1959 | Phillips, Jr. | 333/7 UX |
| 2,999,213 | 9/1961 | Olivieri et al. | 333/7 |
| 3,243,733 | 3/1966 | Hosman | 333/7 |

*Primary Examiner*—Paul L. Gensler

*Attorney, Agent, or Firm*—Sughrue, Rothwell, Mion, Zinn and Macpeak

[57] ABSTRACT

A microwave guide switch having a rotor and stator each having ports spaced at 60° intervals and a connecting waveguide transmission means connected to two ports spaced 120° apart which forms a 3-position, 4-port switch.

8 Claims, 14 Drawing Figures

TWO U SWITCHES USED AS W SWITCH

"R" SWITCH

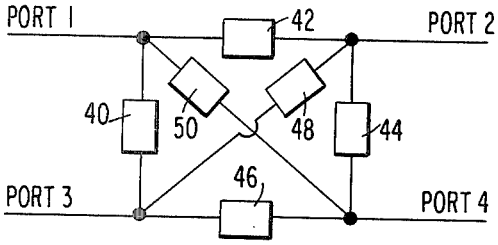
FIG. 5
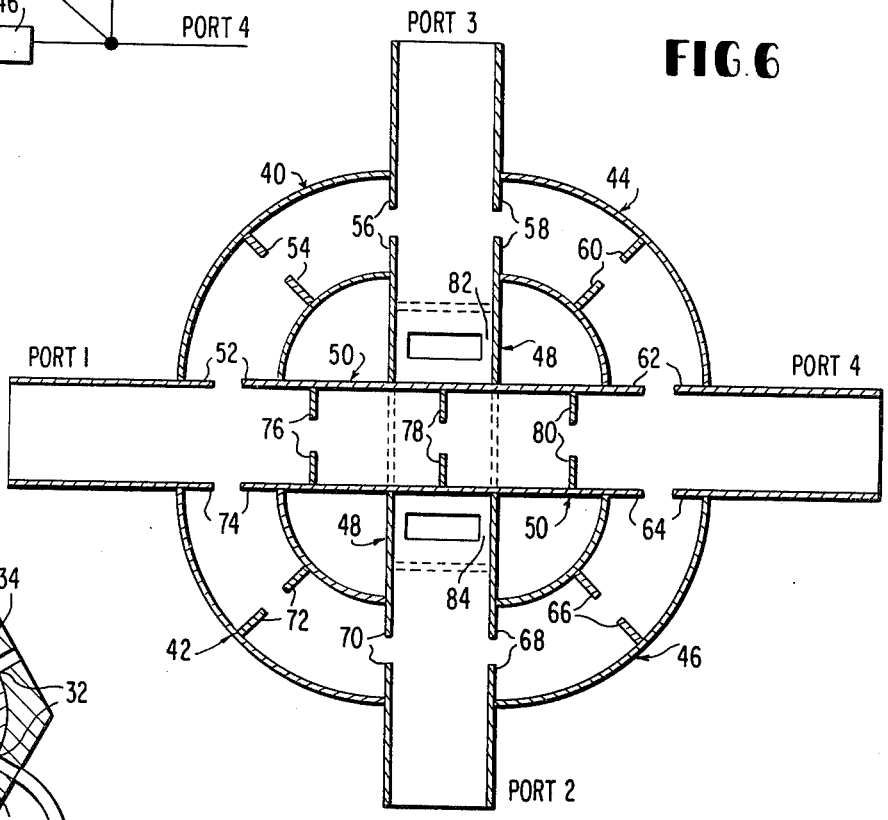
FIG. 6
FIG. 8a
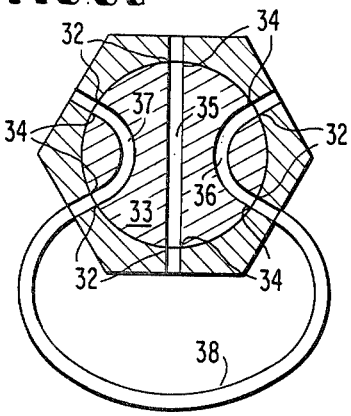
FIG. 8b "U" SWITCH
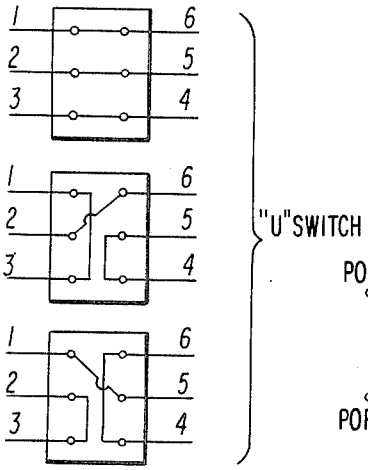
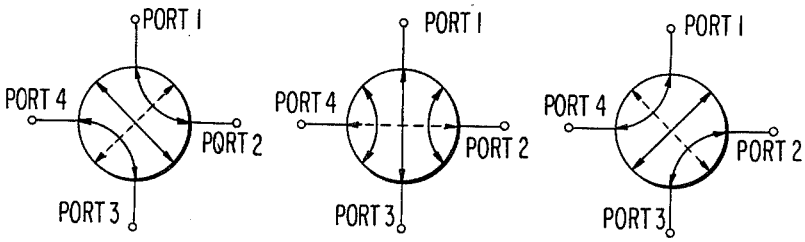
FIG. 7 "T" SWITCH, OR MODIFIED "R" SWITCH
FIG. 8c "U" SWITCH
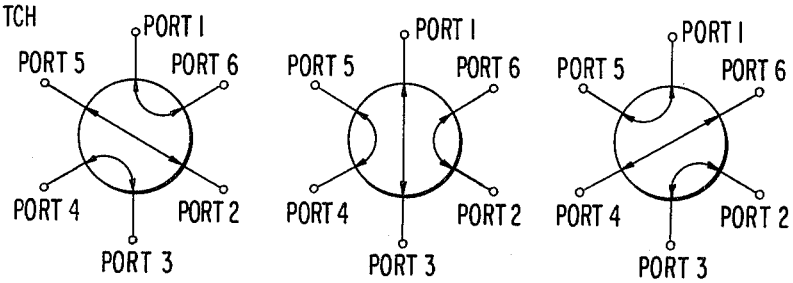

FIG. 9
"U" CONNECTED TO FORM A "T"
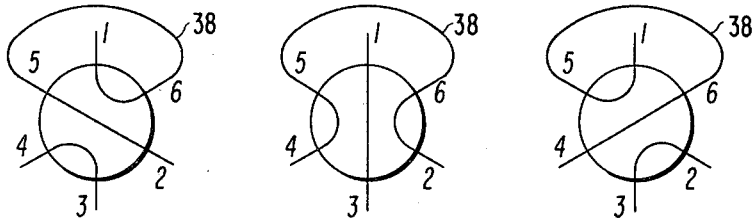
FIG. 10
W SWITCH _ CONVENTIONAL
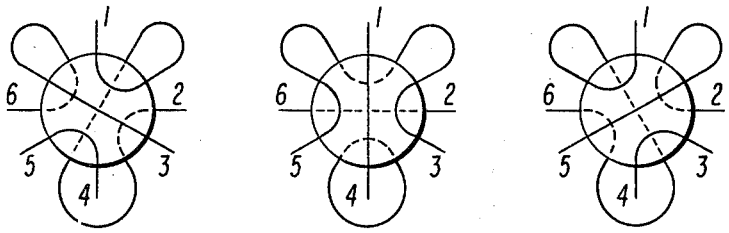
FIG. 11
TWO T SWITCHES USED AS W SWITCH (COMMON SHAFT)
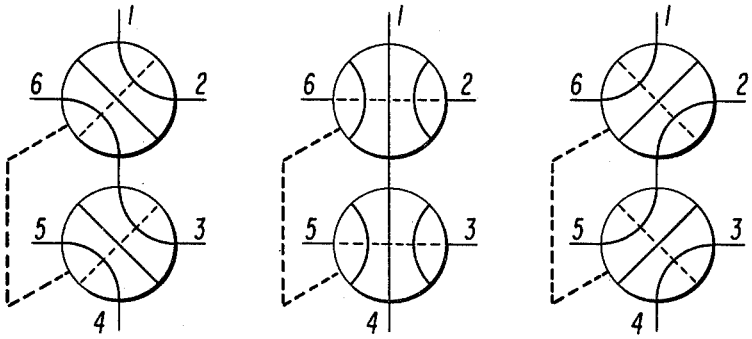
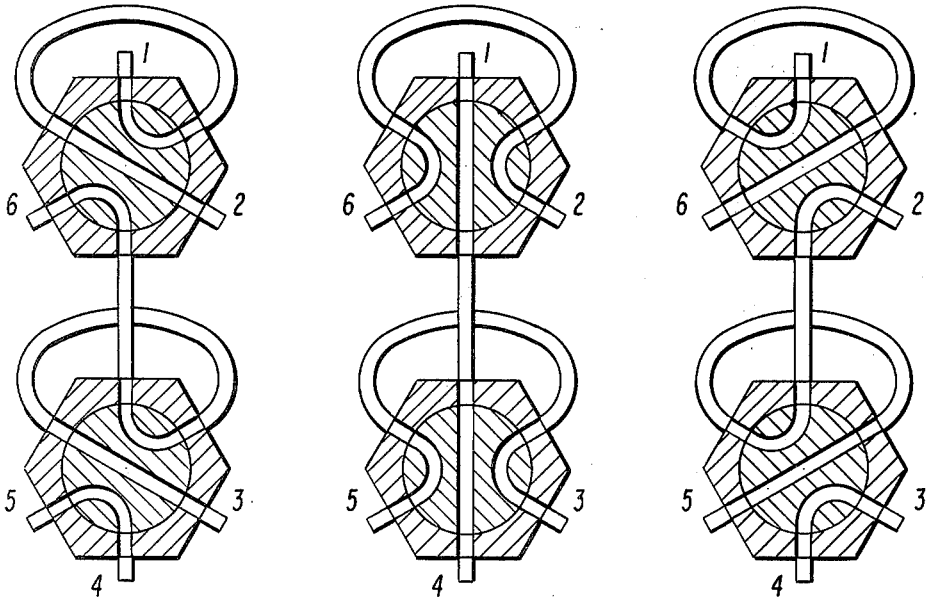
FIG. 12 TWO U SWITCHES USED AS W SWITCH

3-POSITION, 4-PORT WAVEGUIDE SWITCH

BACKGROUND OF THE INVENTION

1. Field of the Invention

The present invention relates to microwave waveguide switching which is used in redundancy switching. Redundancy switching is used to enhance the reliability of communications satellites by switching in redundant system elements for those which have failed. It is common in microwave communications systems to provide stand-by units, such as receivers and transmitters, which are appropriately switched into the system to replace main units which have failed. With the improvement in network topologies, there has developed a requirement for complex microwave switching elements, such as a 4-port, 3-position "T" switch.

The switching apparatus needed in such redundancy switching systems was easy to provide when operation was at low frequency or at low transmission power levels. However, with high frequencies and high power levels, the existing switching apparatus has been inadequate. The deficiency is particularly acute in communication satellite applications, where the high per pound costs of an orbited satellite requires maximum possible switchable combinations of system elements. Further, the switch itself must be small and light in weight.

2. Description of the Prior Art

As described in pending application U.S. Ser. No. 670,290, filed Mar. 25, 1976, to Assal, et al., now Pat. No. 4,070,637, a switch needed for higher order satellite system redundancy configuration is one having four ports and three commuting states or positions. This switch is referred to as a "T" switch, and is illustrated schematically in FIG. 1 of the present application where the three positions are shown.

Since satellite communication systems operate at very high frequencies, the "T" switch must be able to operate efficiently at these frequencies. As is well known in the microwave art, waveguide switches have the best electrical characteristics at these high frequencies. However, the known waveguide switches which provide the three connecting states or positions required in the "T" switch are not suitable in satellite communication systems because of several deficiencies which include excessive size, weight and cost.

A known non-waveguide switch which provides the three connecting states of the present invention is the microwave matrix switch of Lee Laboratories, Lexington, Massachusetts. This microwave matrix switch uses connectors instead of waveguide ports and, therefore, is unsuitable for satellite communication systems where low loss and high power capability are required.

A known waveguide switch called an "R" switch is illustrated in FIG. 2. This switch can provide only the first and second connecting states of the "T" switch which are indicated in FIG. 1. One such "R" switch is available from Sivers Labs in Stockholm, Sweden, and is designated PM 7306J. As shown in FIG. 2, the "R" switch can provide the first connecting state with port 1 connected to port 2 and port 3 connected to port 4. The "R" switch can also provide a second connecting state with port 1 connected to port 3 and port 2 connected to port 4. The "R" switch, however, cannot provide the third connecting state of the "T" switch since port 1 cannot be connected to port 4 simultaneously with port 2 being connected to port 3. This is because the "R" switch has no means to accomplish the cross-over which is required for the third state.

A known waveguide switch called the modified "R" switch does provide the three connecting states of the present invention. The modified "R" switch accomplishes the third state by providing a fourth connecting path which passes beneath the other connecting states in a manner such that the rotor has ports at two levels. As is apparent below, however, the modified "R" switch has several major deficiencies with respect to satellite communications systems, including excessive size, weight and cost.

The modified "R" switch, as shown in FIGS. 3 and 4, includes an unmodified "R" switch. FIGS. 3 and 4 show the modified "R" switch, and the unmodified portion will hereinafter be described first. The "R"[switch is housed in a square structure designated generally by reference numeral 30. Ports 20, 22, 24 and 26 are provided in successive 90° angles around structure 30. For purposes of description and with reference to FIGS. 2 and 4, port 20 corresponds to port 1, port 22 corresponds to port 2, port 24 corresponds to port 4, and port 26 corresponds to port 3. A structure 28, mounted for rotation on drive shaft 10, is provided in structure 30. A waveguide 12 is mounted to structure 28 and has a length such that it can electrically couple port 22 to port 26, or port 20 to port 24, depending on the angle of rotation of the shaft 10. A curved waveguide 16 is mounted to structure 28 and has a curve and a length such that it can electrically couple port 20 to port 22, port 22 to port 24, port 24 to port 26, or port 26 to port 20, depending on the angle of rotation of shaft 10. Waveguide 14 is similarly mounted on structure 28 and connects port 24 to port 26, port 26 to port 20, port 20 to port 22, or port 22 to port 24, depending upon the angle of shaft 10. Obviously, with this unmodified "R" switch, it is impossible to provide the third connecting state of a "T" switch because port 20 cannot be connected to port 24 simultaneously with the connection of port 22 to port 26.

In order to provide the third connecting state required of a "T" switch, the "R" switch can be modified in the following fashion. Specifically, as shown in FIG. 3, a waveguide 18 having four 90° bends can be mounted in structure 28 perpendicular to and below waveguide 12. Waveguide 18 has a length such that it can electrically couple port 20 to port 24 or port 22 to port 26, depending upon the angle of rotation of shaft 10. It is noted from FIGS. 3 and 4 that waveguide 18 accomplishes this cross-over by lying in a plane beneath that of waveguides 12, 14 and 16.

While the modified "R" switch provides the three connecting states or positions required for a "T" configuration, it has several major deficiencies. First, in order to provide waveguide 18, the height of structure 30 has to be at least doubled, and the length and width of structure 30 has to be increased to accommodate the four required 90° bends in waveguide 18. In satellite applications, weight is extremely critical, and this increase in size, and hence weight, is a serious deficiency. Secondly, the addition of waveguide 18 requires a larger diameter shaft and a larger source to drive shaft 10.

Yet another solution to the problem of providing the third connecting state with a cross-over capability is found in copending Application Ser. No. 851,659 to Berman, et al. In that application, there is shown the waveguide switch as shown in FIG. 6 of this application. This waveguide switch is dependent upon six resonant cavities designated as 40, 42, 44, 46, 48 and 50. By tuning and detuning these resonant cavities, the necessary connections to provide the three switching states of the "T" switch are provided. As shown in the electrical analogy of FIG. 5, the cross-over is accomplished by the crossing of the paths of resonant cavities 48 and 50 at different levels.

SUMMARY OF THE INVENTION

Therefore, it is an object of the present invention to provide a waveguide switch having four ports and three connecting states or positions which does not require a cross-over within the rotor.

It is an additional object of this invention to provide a low loss rotary waveguide "T" switch.

It is an additional object of this invention to provide a waveguide switch that is small in size, light in weight, and economical to manufacture.

It is a further object of the present invention to provide a waveguide switch which has ports located 60° apart, and no cross-over within the rotor of the switch.

It is yet a further object of the present invention to provide a switch with three discrete microwave transmission paths within the rotor, which is capable of connecting any one of six ports to three separate ports in three discrete positions of the rotor.

Further according to this invention, the rotary "U" switch has two waveguide ports spaced apart by 120° connected together externally by a waveguide transmission means. By this connection, the "U" switch may function as a "T" switch, but without the use of a cross-over provision within the rotary switch element. The three connecting states or positions of the four ports of the "T" configuration are achieved through the three discrete positions of the "U" switch, and the transmission means connecting the two waveguide ports which are spaced 120° apart.

Further according to this invention, there is provided by the use of two "U" switches on a common shaft which forms a switch in a "W" configuration. This switch in a "W" configuration is again achieved without the necessity of multiple cross-over connections within the rotor structure as in prior art "W" switches.

BRIEF DESCRIPTION OF THE DRAWINGS

FIG. 5 is an electrical network analogy of a resonant chamber-type "T" switch of the prior art.

FIG. 6 is a top plan view of a resonant chamber-type "T" switch of the prior art with the top wall removed. This figure shows the six resonant chambers and the four ports to the "T" switch.

FIG. 7 is a block and functional diagram of the modified "R" switch of FIGS. 3 and 4, which is also known as a "T" switch.

FIG. 8*a* is a top view of a "U" switch with a connecting transmission means on two ports spaced at 120°.

FIG. 8*b* is a diagram showing the three connecting states of a "U" switch.

FIG. 8*c* is a block and functional diagram of a "U" switch according to this invention.

FIG. 9 is a block and functional diagram of a "U" switch with ports 120° apart connected to form an equivalent "T" switch.

FIG. 10 is a block and functional diagram of a prior art "W" switch connection.

FIG. 11 is a block and functional diagram of two "T" switches mounted on a common shaft and with two ports connected which form a "W" switch configuration.

FIG. 12 shows a "W" switch configuration which is formed by the use of two "U" switches connected as "T" switches.

DESCRIPTION OF THE PREFERRED EMBODIMENT

Figure 1:
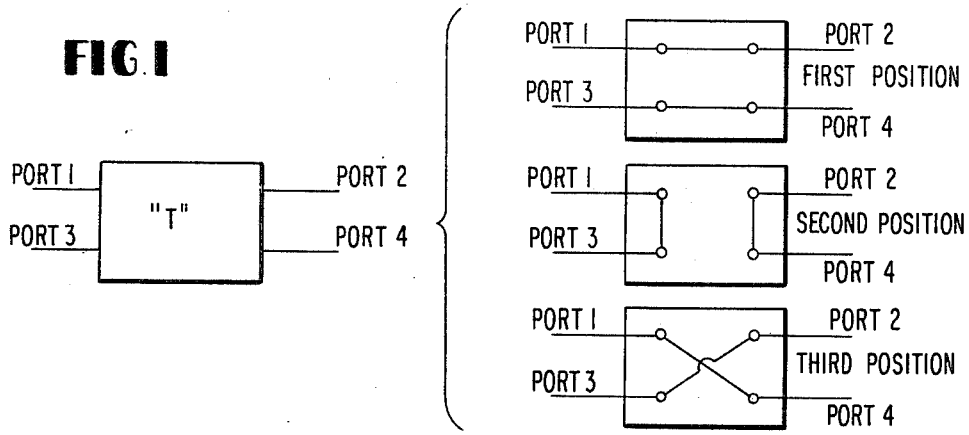
FIG. 1 is a block and functional diagram of a 4-port, 3-connecting state switch of the "T" type.

The "U" switch as depicted in FIGS. 8*a*–8*c* is a waveguide switch having a rotor element 33 and a rotorary switch stator element 31. As depicted in FIG. 8*a*, the stator element has waveguide ports 32 which communicate with input ports 34 of the rotor elements. The rotor element contains three waveguide channels 35, 36 and 37 which connect the waveguide ports when the rotor element is appropriately positioned to any of the three possible discrete positions.

Figure 2:
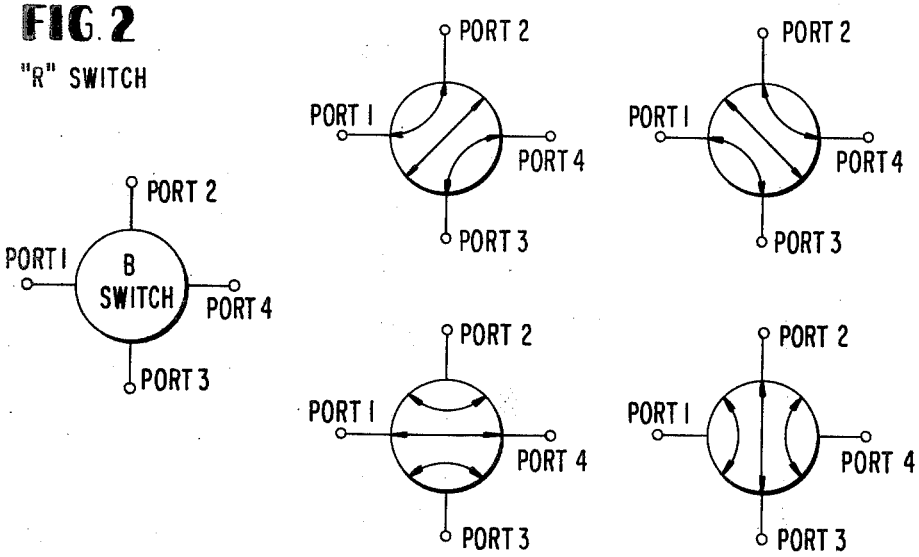
FIG. 2 is a block and functional diagram of the prior art "R" switch.
Figure 3:
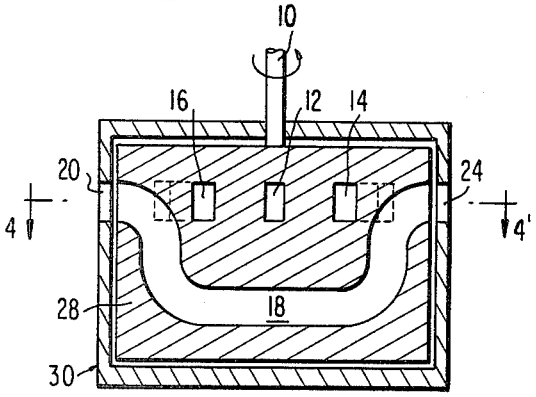
FIG. 3 depicts a prior art modified "R" switch.
Figure 4:
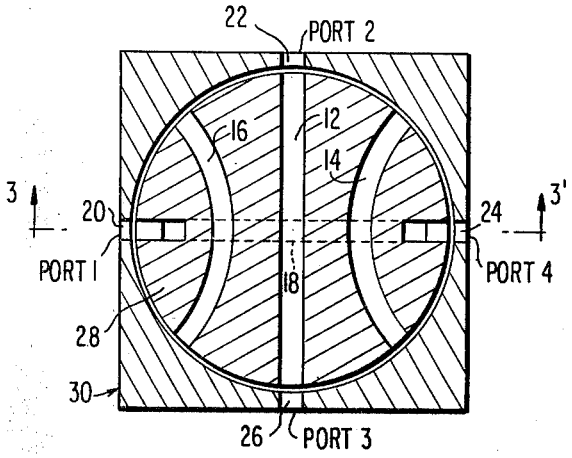
FIG. 4 is a top view of the modified "R" switch depicted in FIG. 3.

The unique feature of the "U" switch is the placement of each rotary input ports 34 at 60° intervals rather than 45° and 90° intervals, as was previously practiced in the prior art "R" and "T" switches as depicted in FIGS. 1–4. It should also be noted that in the "U" type switch, there is no cross-over within the rotor element of waveguide channels. Rather, all three of the connecting transmission means in the rotor, 35, 36 and 37, lie in the same plane, with elements 36 and 37 connecting pairs of ports spaced 60° apart. The connecting transmission means 35 lies on the diameter of the rotor element and connects two ports 180° apart.

As can be seen from FIGS. 8*b* and 8*c*, there are three discrete connecting states associated with the "U" switch. By these connecting states, each port is connected to the port spaced 60° in either direction from it and the port diagonally across the rotor at 180°. There is no means by which ports can be connected to ports spaced 120° away in either direction by means of the rotor.

The unique feature of the "U" switch is that it may be used with an appropriate waveguide connection between any two ports spaced at 120° intervals to create a "T" switch. The connection is by an external waveguide 38 as depicted in FIG. 8*a*.

As shown in FIG. 7, the prior art "T" switch configuration utilizes four ports to the rotary switch stator spaced at 90°, and it is the objective of this switch to provide communication between each port and the other three ports. The "T" configuration requires that there only be three separate and discrete positions for the rotor member. As can be seen in FIG. 7, port 1 may be connected to port 2, port 3 or port 4, port 2 may be connected to port 1, port 4 or port 3. Similarly, port 3 may be connected to port 4, port 1 or port 2. Again, port 4 is connectable to port 3, port 2 and port 1. As pointed out above in the Description of the Prior Art, the "T" configuration which is composed of a modified "R" switch has serious drawbacks in microwave satellite system applications because of its bulky size and weight. This is because of the cross-over required in the rotor.

FIG. 9 shows schematically in block and functional diagrams the connections of the "U" switch connected to form a "T" switch. It will be noted that in FIGS. 8*a* and 9, there is a connection 38 between two ports spaced at 120°. Reference also to FIG. 8*a* shows again the use of a connecting external waveguide 38 between two ports spaced 120°. For convenience, the ports on FIG. 9 have been numbered so that they will correspond precisely with those in FIG. 7. It should also be noted in FIG. 7 that the rotor input ports are spaced at 90° and 45° intervals, while the waveguide ports are spaced at 90° intervals only.

The solution to the problem of cross-over within the rotor of a "T" switch configuration is best seen in FIG. 9 wherein the switch is shown in each of its three states, with the waveguide transmission means 38 connecting two ports which are spaced at 120°. In essence, the "U" switch with the external waveguide provides for the cross-over function of the "T" switch through use of the external waveguide connecting ports at 120°, and the 60° interval spacing of the ports of the stator and the rotor.

In FIG. 9, in the first position, port 1 is connected to port 6 by a rotor transmission channel. Port 6 is connected to port 5 by the waveguide transmission means 38, and port 5 is connected to port 2 by the rotor diagonal waveguide. By this means, port 1 is connected to port 2. Ports 3 and 4 are connected directly by the rotor transmission channel. In a similar manner, port 1 is connected to port 3 and port 2 is connected to port 4 in the second position. In the third position, port 1 is connected to port 4 and port 2 is connected to port 3.

As can be seen in FIG. 8*b*, the "U" switch cross-over is achieved as depicted in the second and third functional drawings, when adjacent ports are connected.

In still a further embodiment of the concept of the "U" switch, reference is now made to FIG. 10 which shows a conventional "W" switch. In the "W" switch, as depicted in FIG. 10, it can be seen that within the rotor element, there are required five separate cross-overs within the single rotor element as well as external waveguide means to accomplish the "W" switch function.

In the "W" switch, in the first position, port 1 is connected to port 2, port 3 is connected to port 6 and port 4 is connected to port 5. In the second position, port 1 is connected to port 4, port 3 is connected to port 5 and port 2 is connected to port 6. In the third position, port 1 is connected to port 6, port 2 is connected to port 5 and port 3 is connected to port 4.

As can be seen from FIGS. 11 and 12, it is feasible to use two "T" switches or two "U" switches which are connected on a common shaft. Each switch has a stator waveguide port switch connected to a stator waveguide port of the other switch. The "U" switch as depicted in FIG. 12 may be substituted for the "T" switch which is depicted in FIG. 11 and connected in the "W" switch configuration.

It is through the use of the "U" switch that both "T" and "W" switch configurations are obtainable without the use of cross-over paths in switch rotors. This is, of course, accomplished by the use of external connections in cooperation with the 60° port spacing to achieve the desired functions.

In this description, the preferred embodiment has been depicted as one utilizing waveguide structures, but it will be apparent to those skilled in this art that other transmission means may be used in this switching configuration without departing from the scope and concept of this invention.

What is claimed is:

1. A rotary microwave switch for switching microwave signals comprising:
   - a rotary switch stator having six waveguide ports spaced at 60° intervals;
   - a rotor having six input ports spaced at 60° intervals and positioned to be simultaneously in communication with said six waveguide ports, respectively;
   - said rotor having a first connecting transmission means across the diameter of the rotor connecting two of said ports spaced 180° apart; and
   - said rotor further having a second and third connecting transmission means on each side of said first connecting transmission means, each connected to two adjacent ones of said ports which are spaced 60° apart.

2. A rotary microwave switch as claimed in claim 1, wherein any two of said six waveguide ports which are spaced 120° apart are connected by an external waveguide transmission means.

3. A rotary microwave switch as claimed in claim 1, wherein said rotor is positionable in three discrete positions, each of which causes a unique interconnection of said waveguide ports via said first, second and third connecting transmission means.

4. A rotary microwave switch as claimed in claim 3, wherein any two of said six waveguide ports which are spaced 120° apart are connected by an external waveguide transmission means.

5. A rotary microwave switch for switching microwave signals comprising:
   - a first rotary switch stator having six waveguide ports spaced at 60° intervals;
   - a first rotor having six input ports spaced at 60° intervals and positioned to be simultaneously in communication with said six waveguide ports, respectively;
   - said first rotor having a first connecting transmission means across the diameter of said first rotor connecting two of said ports spaced 180° apart;
   - said first rotor further having a second and third connecting transmission means on each side of said first connecting transmission means, each connected to two adjacent ones of said ports spaced 60° apart;
   - a second rotary switch stator having six waveguide ports spaced at 60° intervals;
   - a second rotor having six input ports spaced at 60° intervals and positioned to be simultaneously in communication with said six waveguide ports of said second stator, respectively;
   - said second rotor having a first connecting transmission means across the diameter of the rotor connecting two of said ports spaced 180° apart;
   - said second rotor further having a second and third connecting transmission means on each side of said first connecting transmission means connected to two adjacent ones of said ports spaced 60° apart; said first and second stators being coupled together.

6. A rotary microwave switch as claimed in claim 5, wherein said first and second rotors are connected together on a common shaft.

7. A rotary microwave switch as claimed in claim 5, wherein said first rotary switch stator has any two of said six waveguide ports which are spaced 120° apart connected by an external waveguide transmission means, and wherein said second rotary switch stator has any two of said six waveguide ports which are spaced 120° apart connected by an external waveguide transmission means.

8. A rotary microwave switch as claimed in claim 5, wherein one of the waveguide ports on said first rotary switch stator is connected to one of said waveguide ports on said second rotary switch stator.

* * * * *